United States Patent [19]

Keim et al.

[11] Patent Number: 4,920,603

[45] Date of Patent: May 1, 1990

[54] INDUSTRIAL-TYPE WASHING MACHINE

[76] Inventors: Kenneth J. Keim, 520 Ellencroft Dr., Lewisberry, Pa. 17339; William R. Pattison, 419 Springhouse Rd., Camp Hill, Pa. 17011

[21] Appl. No.: 413,998

[22] Filed: Sep. 28, 1989

[51] Int. Cl.[5] ..... B08B 3/02

[52] U.S. Cl. ..... 15/302; 15/306 A; 134/64 R; 134/108; 134/113

[58] Field of Search ..... 15/77, 302, 306 A; 134/64 R, 64 P, 68, 72, 108, 113

[56] References Cited

U.S. PATENT DOCUMENTS

| | | | |
|---|---|---|---|
| 2,011,107 | 8/1935 | Lape, Jr. | 134/72 X |
| 2,359,088 | 9/1944 | Croft | 15/77 X |
| 2,395,397 | 2/1946 | Croft | 134/64 R X |
| 4,097,306 | 6/1978 | Carman | 134/40 X |
| 4,136,217 | 1/1979 | Henley | 134/40 X |
| 4,391,016 | 7/1983 | Kawamura et al. | 15/302 |
| 4,732,173 | 3/1988 | Czaja et al. | 134/72 |

*Primary Examiner*—Philip R. Coe
*Attorney, Agent, or Firm*—C. Hercus Just

[57] ABSTRACT

An industrial-type washing machine having a washing compartment and a rinsing compartment in immediate longitudinal alignment with each other and having spray jets respectively receiving washing and rinsing solutions from separate reservoirs and applied under pressure to the upper and lower surfaces of a strip of metal as it passes along a defined path therefor in the compartments, the exit end of the washing compartment being spaced a limited distance from the entrance end of the rinsing compartment to provide application of liquid-removing air sprays applied against the strip and spaced outwardly from the exit end of the rinsing compartment is an air jet compartment in which air from the jets effects drying of the metal strip.

8 Claims, 2 Drawing Sheets

INDUSTRIAL-TYPE WASHING MACHINE

BACKGROUND OF THE INVENTION

The present invention pertains to an industrial-type washing machine, more specifically adapted to the washing of metal strip products to which oleaginous material or the like previously have been applied, such as during or prior to stamping operations and the like. Previous patents on many different types of industrial washing machines exist and certain ones of these include a washing compartment in alignment with a rinsing compartment as essential components of the industrial washing system. Examples of such prior patents are as follows:

U.S. Pat. No. 2,001,107—Lape, Jr. Aug. 13, 1935
U.S. Pat. No. 2,359,088—Croft Sept. 26, 1944
U.S. Pat. No. 4,097,306—Carman June 27, 1978
U.S. Pat. No. 4,136,217—Henley Jan. 23, 1979

Although the present invention employs washing and rinsing compartments in longitudinal alignment with each other, the invention otherwise readily distinguishes over the aforementioned prior art by providing a relatively compact washing machine having aligned washing and rinsing compartments mounted over reservoirs respectively containing washing and rinsing liquids and otherwise having features not present in the prior art or any other prior art presently known to the inventors.

SUMMARY OF THE INVENTION

It is the principal object of the present invention to provide a preferably compact industrial-type washing machine having an elongated head containing longitudinally aligned washing and rinsing compartments and other beneficial elements, said head being mounted for vertical adjustment above a base member containing at least reservoirs respectively holding washing and rinsing liquids and preferably adapted to be mobile by means of casters provided with suitable brakes, the vertical adjustment of the head permitting alignment thereof with, for example, a machine of some type adapted to perform operation upon a longitudinally extending metal strip or indefinite length and the operation upon the same also including the use of oleaginous or similar additional lubricating material frequently used in stamping operations upon metal strips of various kinds.

Another object of the invention is to provide in said head containing said washing and rinsing compartments strip-wiping members provided in each of said compartments, together with supporting rollers or the like, which define a path of movement for the strip as it passes through said head and both compartments, said compartments respectively containing manifolds located above and below said strip and adapted in the washing compartment to discharge washing compounds against the opposite surfaces of said strip while in the rinsing compartment, the manifolds have jets discharging rinsing liquid against the opposite surfaces of said strip.

A further object of the invention is to space the exit end of said washing compartment from the entrance end of the rinsing compartment to provide a relatively short compartment in which liquid-removing air jets are applied respectively against opposite surfaces of the strip to minimize contamination of the rinsing liquid with the washing liquid and compounds thereon.

One further object of the invention is to provide respectively adjacent the entrance ends of the washing and rinsing compartments with pairs of upper and lower metallic baffle wiping members, the lower member of each pair being fixed to rigid supports in said compartments, while the upper baffle member is pivotally connected to its support for relatively light contact with the upper surface of the moving strip while the fixed lower member is engaged with the strip by gravity, said pairs of baffle members adjacent the entrance of the washing compartment and the baffle members adjacent the entrance of the rinsing compartment being adapted to maintain the washing and rinsing liquids in their respective compartments.

Still one further object of the invention is to provide adjacent the exit end of the rinsing compartment two pairs of such baffle members longitudinally-spaced from each other to maintain as much liquid as possible in the rinse compartment before the strip enters a final compartment extending between said baffle members and the exit opening for the strip at the end of the head, said final compartment containing air-discharging jets respectively above and below the path of movement of the strip for purposes of drying the strip, said jets being supplied with drying air from a suitable air compressor of commercial type normally installed in industrial plants of the type in which an industrial washing machine would be used.

Details of the foregoing objects and of the invention, as well as other objects thereof are set forth in the following specification and illustrated in the accompanying drawings comprising a part thereof.

DETAILED DESCRIPTION OF THE PREFERRED EMBODIMENTS OF THE INVENTION

Figure 3:
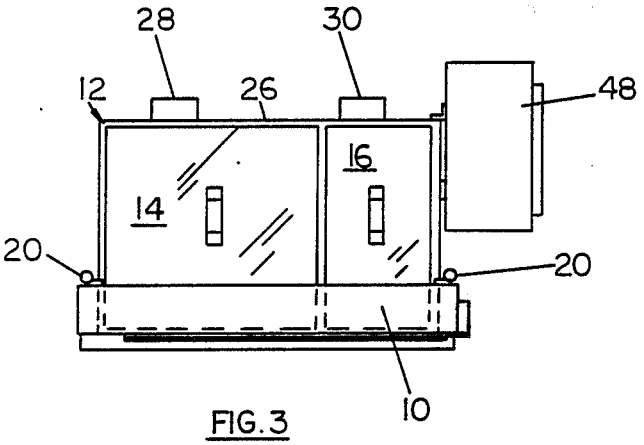
FIG. 3 is a top plan view of the machine shown in FIGS. 1 and 2.
Figure 1:
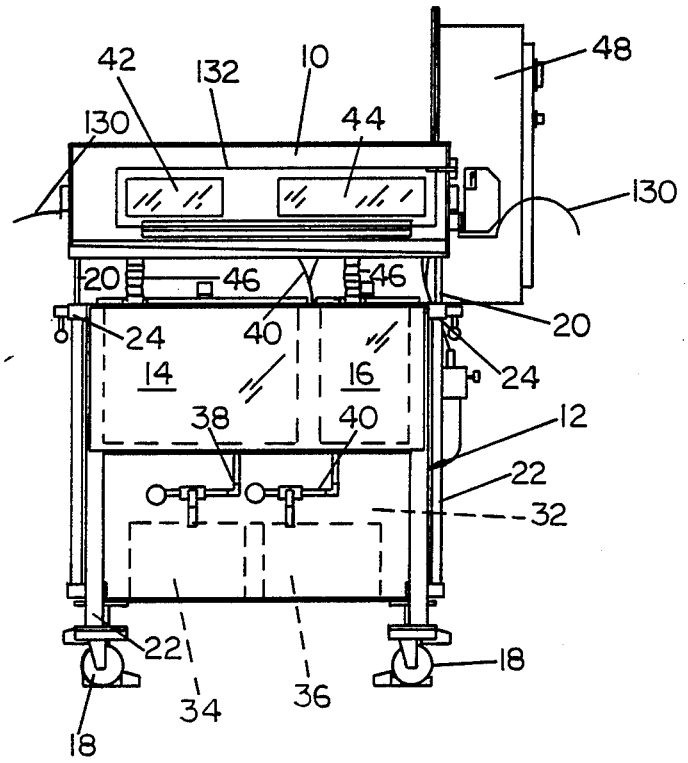
FIG. 1 is a front vertical elevation of the machine comprising the present invention and illustrating a head, in which the washing and rinsing compartments are mounted, being disposed adjustably vertically above a base in which liquid-containing washing and rinsing solutions are contained.
Figure 2:
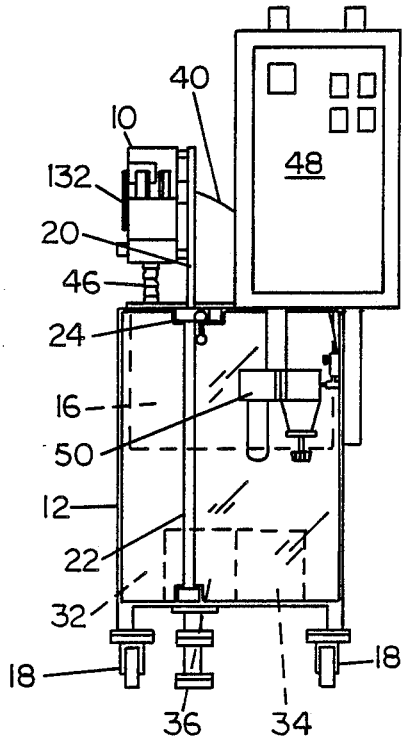
FIG. 2 is a vertical elevation of the right-hand end of the machine illustrated in FIG. 1.

Referring to FIGS. 1–3, it will be seen that the machine is relatively compact and, without restriction thereto, but for purposes of illustration, the preferred embodiment of the machine is approximately 3 feet in length, the head 10 is of the order of between 9 and 12 inches in height, and the base 12 has a length approximately the same as the head 10, and is approximately 30 inches in height. The base 12 contains reservoirs 14 and 16, within a suitable sheet metal housing, respectively containing washing and rinsing solutions. Preferably, the base 12 is mobile and supported upon casters 18, preferably of the type which have brakes associated therewith.

Referring to FIG. 3, it will be seen that the head 10 is relatively narrow, as also shown in FIG. 2, and, at opposite ends thereof, is attached respectively to a pair of vertical shafts 20 longitudinally movable within tubes 22, which are affixed to the base 12 and include locking members 24 to secure the head 10 at a desired vertical position with respect to base 12 and also with respect to any other machine or the like, not shown, from which a strip of metal may be exiting after having an operation performed thereon, following which it is to be cleansed and dried.

As seen in FIG. 3, immediately attached to the rear wall of reservoirs 14 and 16 are heaters 28 and 30 adapted to heat the washing solution in tank or reservoir 14 and the rinsing solution in tank or reservoir 16. Without restriction thereto but by way of example, both the washing and rinsing solutions are maintained preferably at a temperature of approximately 150° F.

The base 12 also contains a lower compartment 32, which is below the bottom walls of the tanks or reservoirs 14 and 16 and includes a space within which pumps 34 and 36 are mounted and connected by suitable plumbing elements 40 to the washing compartment 42 and rinsing compartment 44 within the head 10, details of which are described hereinbelow.

As shown in FIGS. 1 and 2, the washing and rinsing compartments 42 and 44 in head 10 are connected by flexible hoses 46 which extend from the lower portions of said compartments into the respective reservoirs 14 and 16 to drain washing and rinsing solutions from the compartments therefor in the head 10 back to the reservoirs in the base 12. As shown in all three figures, there is a control box 48 supported adjacent the right-hand end of the cabinet 12 as shown in FIG. 1, said control box containing electric circuitry, certain elements of which are described in detail hereinafter. The base 12 also supports, as shown particularly in FIG. 2, an air filter and regulating unit 50.

Figure 4:
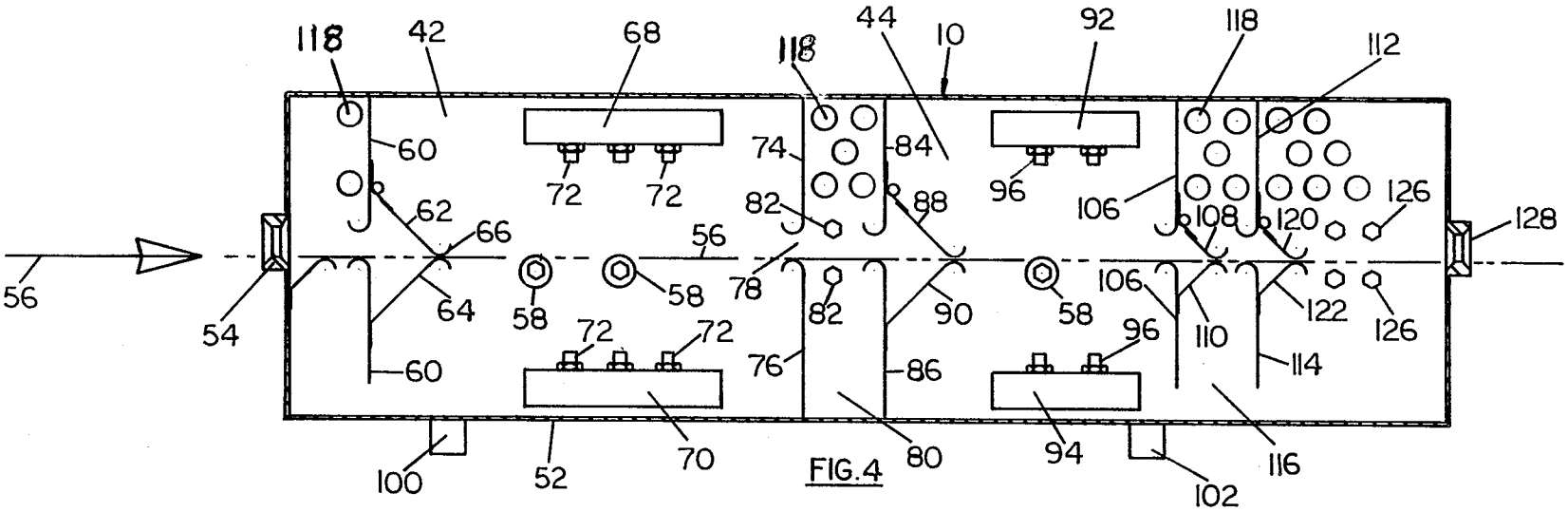
FIG. 4 is a vertical longitudinal sectional view, in a scale larger than employed in the preceding figures of the head shown in FIGS. 1–3, which contains the washing and rinsing compartments and other features associated therewith.
Figure 5:
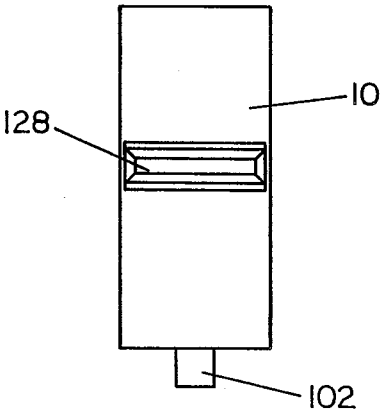
FIG. 5 is an end view of the head as shown at the right-hand end of FIG. 4.

Referring now to the longitudinal vertical section of the head 10 as illustrated in FIG. 4, said head comprises an overall shell 52 formed from sheet metal or otherwise and having at the left-hand end thereof, as shown in said figure, an inlet opening 54 through which a strip 56 of metal or the like is introduced to the interior of the head 10. Suitably positioned within the head 10 to define the path of movement of the strip 56 are a plurality of longitudinally-spaced supporting rollers 58 respectively in the washing compartment 42 and rinsing compartment 44 to support and guide the strip as it passes through said compartments. It also will be seen from FIG. 4 that the interior of the head 10 includes a plurality of pairs of vertical support members 60 extending transversely across and attached at opposite ends thereof to the sidewalls of washing compartment 42 and spaced inwardly from the inlet opening 54. From FIG. 4, it will be seen that the upper edge of the lower vertical support members 60 terminates in an arcuate configuration adjacent the path of movement of the strip 56, while the lower edge of the upper member 60 is spaced therefrom but likewise terminates in an arcuate configuration to prevent scratching or other marring of the surface of the strip passing through the machine. The members 60 respectively support lower and upper baffle members 62 and 64, the upper one extending downwardly and forwardly in the direction of movement of the strip 56 and terminating in an arcuate configuration 66, said member 62 being hingedly connected to the upper support member 60, while the lower member 64 is fixedly connected to the lower support member 60. The terminal ends of the members 62 and 64 are arcuately configurated to minimize the possibility of causing any damage to a strip passing between said terminal ends of said members. As the strip 56 passes beyond the wiping members 62 and 64, it passes between manifolds 68 and 70, respectively having discharge jets 72 thereon respectively above and below the strip 56, said jets being connected with the pump 34 associated with reservoir 14, and thereby adapted to discharge, under relatively high pressure, washing solutions containing any appropriate compound adapted especially to remove any particular type of material coated upon or otherwise disposed on the strip 56 as it enters the washing compartment 42.

The exit end of the washing compartment 42 is defined by another pair of vertical and transversely disposed sheet-like members 74 and 76, which are fixedly connected to the top and bottom of the head 10 and respectively extending toward each other therefrom to define a passage 78 through which the strip 56 passes between arcuate configurations respectively on the spaced edges of the members 74 and 76, the strip then passing into a relatively short compartment 80 wherein liquid-removing jets of air are discharged from suitable discharge jets 82 respectively disposed above and below the path for the strip 56 and serving to minimize contamination of the rinse solution with any of the washing solution which remains upon the strip as it passes through compartment 80.

The exit end of compartment 80 is defined by another pair of vertical and transversely extending support members 84 and 86 which are respectively affixed at the opposite ends and the upper and lower edges thereof to the top and bottom, as well as opposite sides of the head 10, the innermost edges of said members also being arcuately configurated to prevent damage to the passing strip and the upper member 84 hingedly supporting a downwardly and forwardly extending baffle member 88, while the lower member 86 supports an upwardly and forwardly extending rigidly-supported baffle member 90, which, together with the space between the adjacent ends of members 84 and 86, define the inlet to the rinsing compartment 44 in which manifolds 92 and 94 are mounted respectively in the upper and lower portions of said compartment and are provided with water discharge jets 96 directed respectively against the opposite surfaces of the strip 56 to apply heated rinsing water against opposite surfaces of said strip to rinse washing liquid from the same. The manifolds 92 and 94 are connected by suitable conduits, not shown in detail, to a water pump 36 of suitable type disposed, for example, within the space 32 in base 12, as shown in phantom in FIGS. 1 and 2.

Referring to FIG. 4, it also will be seen that the lower wall of the washing compartment 42 is provided with an outlet 100 connected to one of the drain hoses 46, shown in FIGS. 1 and 2, to return washing solution to the reservoir 14, and rinsing compartment 44 also is provided with an outlet 102, which similarly is connected to drain hose 46 that returns the rinsing solution to reservoir 16.

The exit end of rinsing compartment 44 is defined by another pair of vertical and transversely disposed support members 104 and 106, the opposite ends and upper edge of upper member 104 being securely affixed to the top and sidewalls of the head 10 and the lower edge thereof terminates in an arcuate configuration and also hingedly supports a forwardly and downwardly extending baffle member 108, while the lower member 106 is spaced at the bottom from the bottom wall of the rinse compartment 44 and the upper edge thereof is in line with the path of movement for the strip 56 and is arcuately configurated and also fixedly supports an upwardly and forwardly extended baffle member 110. A duplicate of the members 104 and 106 is shown in the form of similar vertical and transversely extending support members 112 and 114, which are spaced from the members 104 and 106 a limited distance to form a compartment 116, which is provided with a plurality of vent openings 118, which discharge to atmosphere. The members 112 and 114 also respectively support a hingedly-connected upper baffle member 120 and a rigidly-connected lower baffle member 122, which respectively engage opposite surfaces of the strip 56 as it moves into the last compartment 124 in which a plurality of air drying discharge members 126 respectively are disposed above and below the opposite surfaces of the strip 56 and discharge drying air, such as supplied by a remote compressor, against opposite surfaces of the strip before it exits through discharge port 128. The compressor is of conventional type, not shown, such as used in many types of industrial plants.

Referring to FIG. 1, it will be seen that, if desired, the inlet end of head 10 may be provided with a curved strip-engageable inlet guide 130 and, similarly, the exit end of the head 10 is provided with another arcuate strip-supporting guide 130.

The front wall of head 10 within which washing and rinsing compartments 42 and 44 are located is provided with an elongated opening through which the operation of the washing and rinsing equipment may be seen. However, when the various sprays are in operation, it is obvious that said opening should be closed and this is accomplished by means of an elongated door 132, which comprises a transparent member circumscribed by a metal rim that is hingedly connected preferably at the bottom edge to the front wall of head 10. To insure that no accidental discharge of spray or otherwise may occur while the washing and rinsing operation is transpiring, a suitable interlock controlled by electrical equipment enclosed within box 48, not shown in detail, secures the door 132 against opening when the washing and rinsing cycles are taking place, and such cycles are not operable unless door 132 is secured in closed position.

From the foregoing, it will be seen that the present invention provides a very compact, efficient, and relatively simple and readily operable washing and rinsing machine of an industrial type through which a metal strip can be passed to be removed of extraneous material and otherwise washed and dried as it exits from the head of the machine.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

We claim:

1. An industrial-type washing machine for removing from a continuous metal strip oleaginous and similar materials used in preceding operations upon said strip, said machine comprising in combination, a. a washing compartment in compact longitudinal alignment with a rinsing compartment, b. each of said compartments being mounted above reservoirs respectively to contain washing and rinsing liquids, c. each of said compartments having longitudinally-spaced support and guide rollers therein defining a longitudinal path of movement for a strip passing through said compartments, d. upper and lower spray manifolds in each of said compartments provided with longitudinally-spaced discharge jets adapted to discharge liquid upon opposite surfaces of a strip when moving through said compartments, e. an inlet for said strip in the end of said washing compartment opposite said rinsing compartment and an exit in the end of said rinsing compartment opposite said washing compartment, f. each of said reservoirs having a pump connected thereto and conduits leading respectively therefrom to said spray manifolds in said compartments, g. liquid-removing air spray means mounted within a space of limited length between said compartments and a compressor connected thereto removes washing liquid from said strip before entering said rinsing compartment to minimize contamination of rinsing liquid, h. coacting relatively fixed and movable pairs of baffle members supported respectively below and above said path of movement and positioned respectively adjacent the inlets of said compartments and an additional pair mounted at the exit of said rinsing compartment, and i. drying air jets at the exit of said rinsing compartment and connected to a compressor to provide drying air under pressure to be applied against opposite surfaces of said strip.

2. The washing machine according to claim 1 in which at least said reservoirs are part of a base for said machine and said washing and rinsing compartments as a unit are adjustable vertically relative to said base to adapt the path for said strip in said compartments to registration with other equipment from which said metal strip is being discharged for cleansing and drying.

3. The washing machine according to claim 1 further including a heater directly attached to and supported by one wall of each reservoir respectively adapted to contain washing and rinsing solutions.

4. The washing machine according to claim 1 characterized by said washing and rinsing compartments having a front wall provided with elongated openings to permit viewing the operations being performed in said compartments, and said openings having transparent doors movably connected to said compartments, and an interlocking control system having included therein means to operate latches for said doors to prevent opening the same while spraying is occuring within said compartments.

5. The washing machine according to claim 1 in which the lower baffle members in said compartments extend forward and upwardly relative to said path for said metal strips and are fixedly supported in said compartments and said upper baffle members extend forwardly and downwardly relative to said path for said strips and the upper edges of said members are hingedly connected to downwardly extending support means therefor within said compartments.

6. The washing machine according to claim 5 in which said compartments respectively adjacent opposite ends thereof have pairs of fixed vertical members in a common plane extending transversely across said compartments and said members of each pair respectively extending upwardly and downwardly relative to said path for said strips and terminating in arcuately curved edges adjacent said path to provide smooth support and guide surfaces for said strip and the upper vertical members of each pair extending downwardly from above said path for said strip and the lower edges thereof being spaced a limited distance above said path and terminating in arcuately curved edges extending upwardly to insure smooth contact with a strip of metal extending along said path therefor.

7. The washing machine according to claim 6 further characterized by said baffle members respectively in said successive compartments being connected to and supported by the vertical members adjacent the entrance end of each compartment.

8. The washing machine according to claim 5 further including outwardly spaced from the exit end of said rinsing compartment an additional pair of vertical members respectively extending downwardly toward said path for said strip of metal and upwardly toward said path and the edges thereof respectively adjacent said path terminating in arcuately curved configuration, and said additional vertical members respectively supporting baffle members and the exit end of said rinsing compartment being spaced from said additional vertical members and baffle members thereon to provide a compartment provided with jets connected to compressor means to direct drying air against strip before exiting from the machine.

* * * * *